US009753421B2

(12) United States Patent
Asano

(10) Patent No.: US 9,753,421 B2
(45) Date of Patent: Sep. 5, 2017

(54) IMAGE FORMING APPARATUS WITH SEPARATE INTERLOCKS FOR MOTORS AND SENSORS

(71) Applicant: Yoshihiro Asano, Kanagawa (JP)

(72) Inventor: Yoshihiro Asano, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/800,732

(22) Filed: Jul. 16, 2015

(65) Prior Publication Data

US 2016/0026142 A1 Jan. 28, 2016

(30) Foreign Application Priority Data

Jul. 28, 2014 (JP) ..... 2014-153122

(51) Int. Cl.
*G03G 21/00* (2006.01)
*G03G 15/00* (2006.01)
*G03G 21/16* (2006.01)

(52) U.S. Cl.
CPC ..... *G03G 15/5004* (2013.01); *G03G 21/1623* (2013.01); *G03G 21/1633* (2013.01); *G03G 21/1652* (2013.01); *G03G 2215/0078* (2013.01); *G03G 2221/1684* (2013.01)

(58) Field of Classification Search
CPC ..... G03G 21/1623; G03G 21/1633; G03G 2215/0078; G03G 2215/00784; G03G 15/5004; B65H 2402/45
See application file for complete search history.

(56) References Cited

U.S. PATENT DOCUMENTS 5,359,392 A * 10/1994 Muto ..... G03G 15/2003 219/216
7,628,483 B2 * 12/2009 Nakagawa ..... B41J 29/56 347/108
7,664,427 B2 * 2/2010 Kawasumi ..... G03G 21/1633 399/110
2007/0242960 A1 * 10/2007 Kobayashi ..... G03G 15/2064 399/13

FOREIGN PATENT DOCUMENTS

JP 2006-163192 6/2006
JP 2011-128418 6/2011

* cited by examiner

*Primary Examiner* — Justin Olamit
(74) *Attorney, Agent, or Firm* — Harness, Dickey & Pierce P.L.C.

(57) ABSTRACT

An electronic apparatus includes: a unit part that can be pulled out of a main unit; a cover part that is configured to, when being close, cover the unit part; a lock part that, when the cover part is being open, is movable to a first position where it is possible to pull the unit part out of the main unit and is movable to a second position where it is impossible to pull the unit part out of the main unit; a detection unit configured to, when being supplied with power, detect an internal state of the unit part; and a first power supply unit configured to shut off power supply to the detection unit when the lock part is moved to the first position, and supply power to the detection unit when the lock part is moved to the second position.

9 Claims, 6 Drawing Sheets

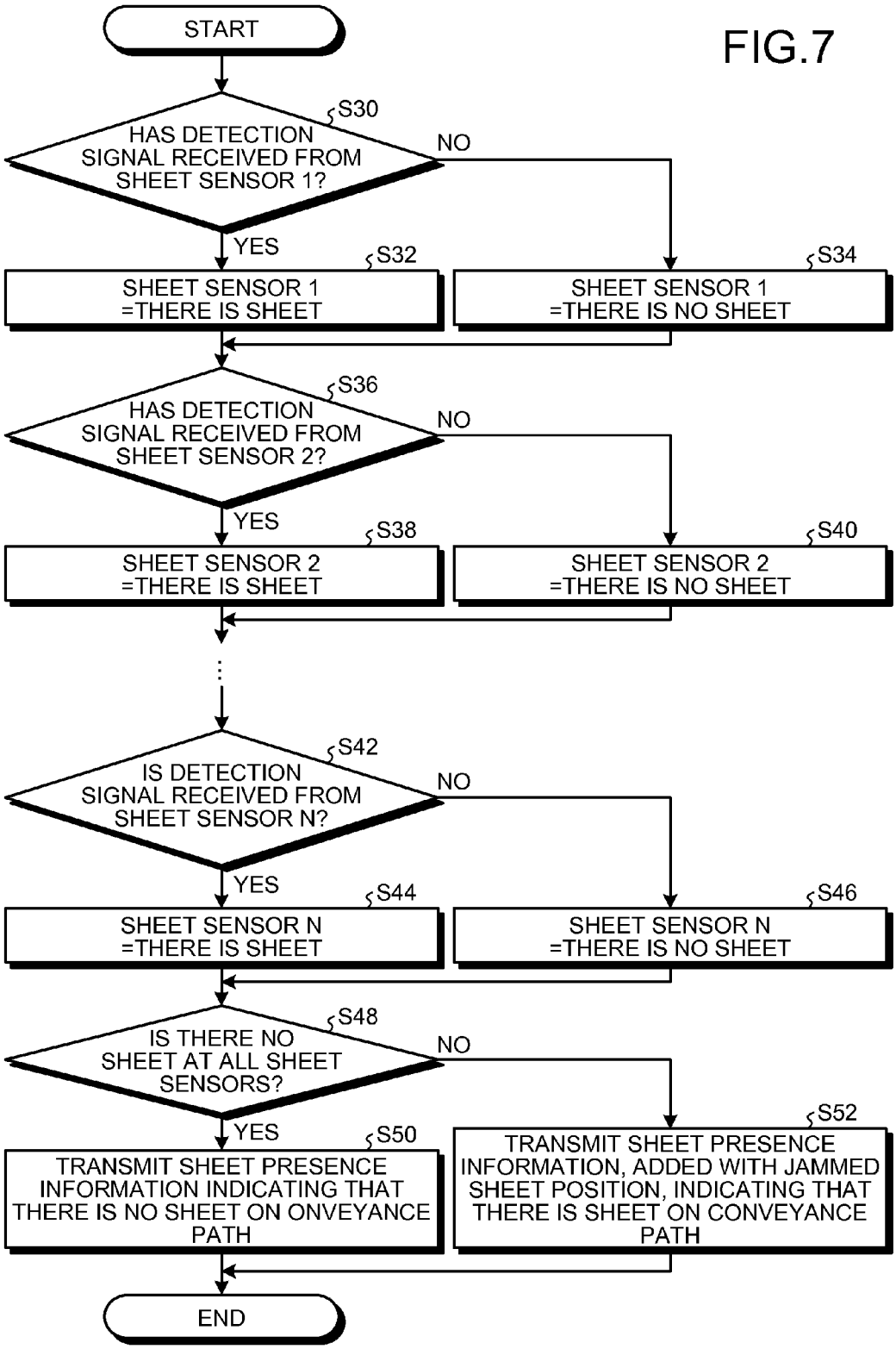
FIG.7
START
S30
HAS DETECTION SIGNAL RECEIVED FROM SHEET SENSOR 1?
NO
YES
S32
SHEET SENSOR 1 =THERE IS SHEET
S34
SHEET SENSOR 1 =THERE IS NO SHEET
S36
HAS DETECTION SIGNAL RECEIVED FROM SHEET SENSOR 2?
NO
YES
S38
SHEET SENSOR 2 =THERE IS SHEET
S40
SHEET SENSOR 2 =THERE IS NO SHEET
S42
IS DETECTION SIGNAL RECEIVED FROM SHEET SENSOR N?
NO
YES
S44
SHEET SENSOR N =THERE IS SHEET
S46
SHEET SENSOR N =THERE IS NO SHEET
S48
IS THERE NO SHEET AT ALL SHEET SENSORS?
NO
YES
S50
TRANSMIT SHEET PRESENCE INFORMATION INDICATING THAT THERE IS NO SHEET ON ONVEYANCE PATH
S52
TRANSMIT SHEET PRESENCE INFORMATION, ADDED WITH JAMMED SHEET POSITION, INDICATING THAT THERE IS SHEET ON CONVEYANCE PATH
END

IMAGE FORMING APPARATUS WITH SEPARATE INTERLOCKS FOR MOTORS AND SENSORS

CROSS-REFERENCE TO RELATED APPLICATIONS

The present application claims priority to and incorporates by reference the entire contents of Japanese Patent Application No. 2014-153122 filed in Japan on Jul. 28, 2014.

BACKGROUND OF THE INVENTION

1. Field of the Invention

The present invention relates to an electronic apparatus, an image forming apparatus, and a state detection method.

2. Description of the Related Art

Conventionally, when a failure occurs in an image forming apparatus, processing for fixing the failure is performed and, after the processing, an operation check for checking whether the failure has been fixed is performed. For example, when paper jam occurs due to, for example, a recording medium jammed in the image forming apparatus, paper jam processing is performed and, after the paper jam processing, an operation check for checking whether the paper jam has been fixed is performed.

A technique for switching on/off the power of the main unit according to the opening and closing angle of the front door of the image forming apparatus in order to easily perform the operation check is disclosed (see, for example, Japanese Laid-open Patent Publication No. 2006-163192). In the image forming apparatus described in Japanese Laid-open Patent Publication No. 2006-163192, by switching on/off each power according to each position of the opening and closing angle, it is possible to let a user know the position at which processing for a failure, such as paper jam, is to be performed even when the front door is being open. Conversely, by turning on the power of the main unit according to the opening and closing angle of the front door, a service person can perform an operation check when the front door is being open.

The image forming apparatus according to Japanese Laid-open Patent Publication No. 2006-163192, however, has a problem in that it is required to pay attention to the angle of the front door all the time when an operation check is performed.

In view of the above-descried circumstances, there is a need to provide an electronic apparatus, an image forming apparatus, and a state detection method that increase the convenience in the operation check after processing on a failure.

SUMMARY OF THE INVENTION

It is an object of the present invention to at least partially solve the problems in the conventional technology.

An electronic apparatus includes: a unit part that can be pulled out of a main unit; a cover part that is disposed in a direction in which the unit part is pulled out, with respect to the unit part, and is configured to, when being close, cover the unit part; a lock part that, when the cover part is being open, is movable to a first position where it is possible to pull the unit part out of the main unit and is movable to a second position where it is impossible to pull the unit part out of the main unit; a detection unit configured to, when being supplied with power, detect an internal state of the unit part; and a first power supply unit configured to shut off power supply to the detection unit when the lock part is moved to the first position, and supply power to the detection unit when the lock part is moved to the second position.

A state detection method is performed by an electronic apparatus. The electronic apparatus includes: a unit part that can be pulled out of a main unit; a cover part that is disposed in a direction in which the unit part is pulled out, with respect to the unit part, and is configured to, when being close, covers the unit part; and a lock part that, when the cover part is being open, is movable to a first position where it is possible to pull the unit part out of the main unit and is movable to a second position where it is impossible to pull the unit part out of the main unit. The state detection method includes: detecting an internal state of the unit part when power is being supplied; and shutting off power supply to a detection unit when the lock part is moved to the first position and supplying power to the detection unit when the lock part is moved to the second position.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 7 is a flowchart of a procedure of sheet presence determination processing performed by a sheet presence determination unit.

DETAILED DESCRIPTION OF THE PREFERRED EMBODIMENTS

With reference to the accompanying drawings, an embodiment of an electronic apparatus, an image forming apparatus, and a state detection method will be described in detail below.

Figure 1:
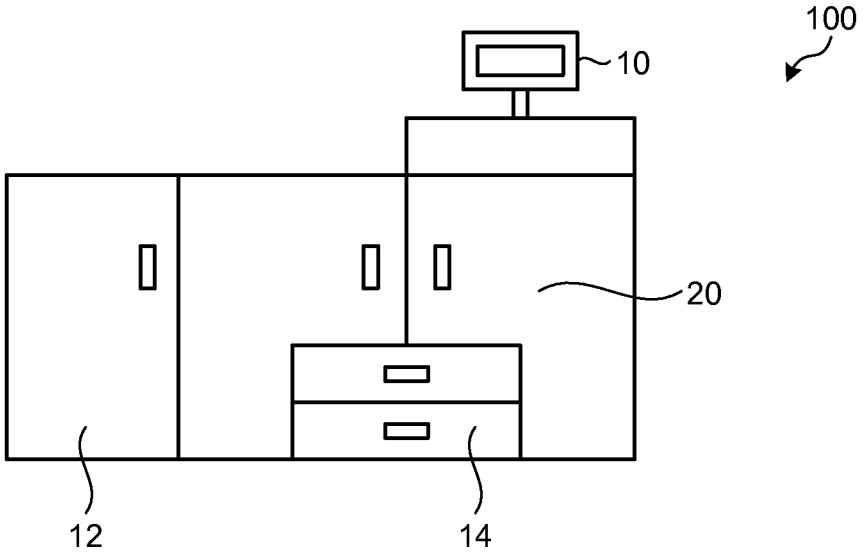
FIG. 1 is a configuration diagram of an image forming apparatus according to an embodiment.
Figure 2:
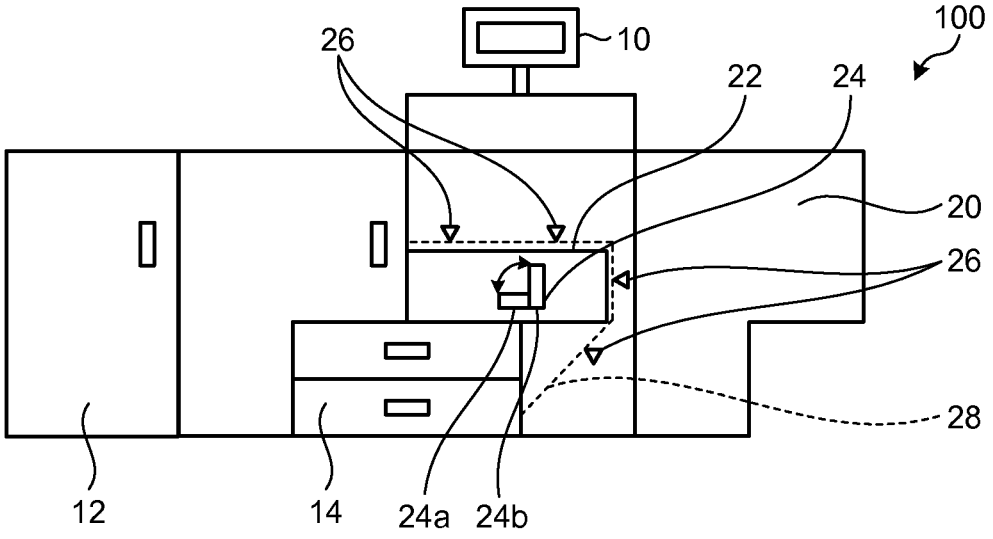
FIG. 2 is a configuration diagram of the image forming apparatus according to the embodiment.
Figure 3:
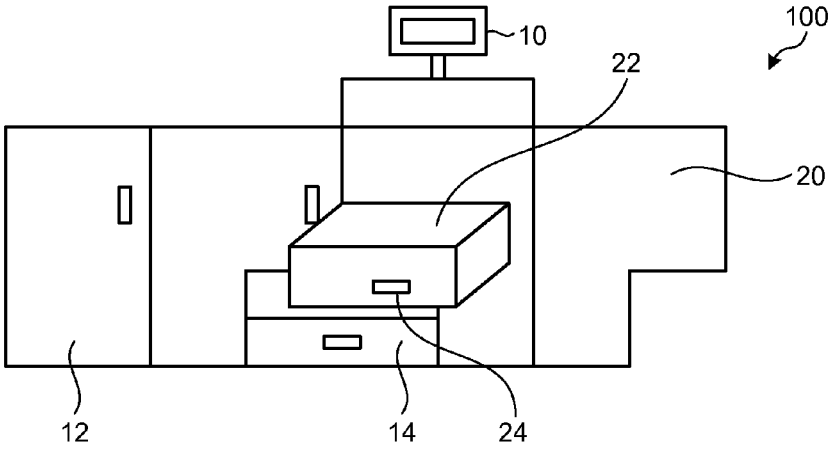
FIG. 3 is a configuration diagram of the image forming apparatus according to the embodiment.

FIGS. 1 to 3 are configuration diagrams of an image forming apparatus according to the embodiment. FIG. 1 shows an image forming apparatus 100 in which a front door 20 is closed. FIG. 2 shows the image forming apparatus in which the front door 20 is opened. FIG. 3 shows the image forming apparatus 100 in which the front door 20 is opened and a drawer unit 22 is pulled out.

As shown in FIG. 1, in the image forming apparatus 100 according to the embodiment, the main unit is covered with the front door 20 (a cover part). The image forming apparatus 100 includes a sheet feeding tray 14 that is disposed at a lower part of the main unit and on which a large number of sheets (recording media) are stacked and housed. The image forming apparatus 100 further includes a monitor 10 that is disposed at an upper part of the main unit and that displays a setting screen etc. A post-processing apparatus 12 that performs various types of processing including stapling, punching, rotating, interleaving, and offset is connected to the main unit.

As shown in FIG. 2, the image forming apparatus 100 according to the embodiment includes the drawer unit (a unit part) 22 configured so as to be able to be pulled out of the main unit. The front door 20 is disposed in the direction in which the drawer unit 22 is pulled out, with respect to the drawer unit 22. When the front door 20 is closed, the front door 20 covers the drawer unit 22. In other words, as shown in FIG. 2, when the front door 20 is opened, the user can view the drawer unit 22.

In the drawer unit 22, a conveyance path 28 on which a sheet is conveyed is disposed. Along the conveyance path 28 provided in the drawer unit 22, multiple sheet sensors 26 are disposed. Each of the sheet sensors 26 is a sensor that detects the internal state of the drawer unit 22. In the embodiment, each of the sheet sensors 26 detects whether there is a sheet conveyed on the conveyance path 28.

FIG. 2 shows the configuration in which four sheet sensors 26 are disposed. Alternatively, three or less, or five or more, sensors may be disposed. FIG. 2 shows the configuration in which the sheet sensors each of which detects whether there is a sheet are disposed. Alternatively, a sensor that detects a remaining amount of a consumable, such as a detection sensor of a stapler that is a peripheral, may be used.

A lever 24 (lock part) for pulling out or inserting the drawer unit 22 is disposed on the drawer unit 22. Because the conveyance path 28 is in the drawer unit 22, when paper jam occurs, paper jam processing is performed in a state where the front door 20 of the main unit is opened and the drawer unit 22 is pulled out as shown in FIG. 3.

By moving the lever 24 to switch the direction of the lever 24, which is disposed on the drawer unit 22, the locking state of the drawer unit 22 with respect to the main unit is settled. In other words, the lever 24 is movable to a position (first position) where it is possible to pull the drawer unit 22 out of the main unit and is movable to a position (second position) where it is impossible to pull the drawer unit 22 out of the main unit.

Specifically, according to the embodiment, when the lever 24 is moved to be at a horizontal position (24*a*), the drawer unit 22 is unlocked so that it is possible to pull the drawer unit 22 out. On the other hand, when the lever 24 is moved to be at a vertical position (24*b*), the drawer unit 22 is locked so that it is impossible to pull the drawer unit 22 out. According to the embodiment, the drawer unit 22 is unlocked when the lever is at the horizontal position and locked when the lever is at the vertical position; however, it is not limited to this and the drawer unit 22 may be locked and unlocked at any directions. Thus, for example, the direction of the lever 24 may be switched oppositely to those according to the embodiment or the lever 24 may be turned 180 degrees.

For the embodiment, the image forming apparatus having the electronic apparatus is exemplified. Alternatively, an apparatus other than image forming apparatuses may have the drawer unit as long as the front door and the drawer unit that is locked with the lever are disposed and a sensor is mounted on the drawer unit.

Figure 4:
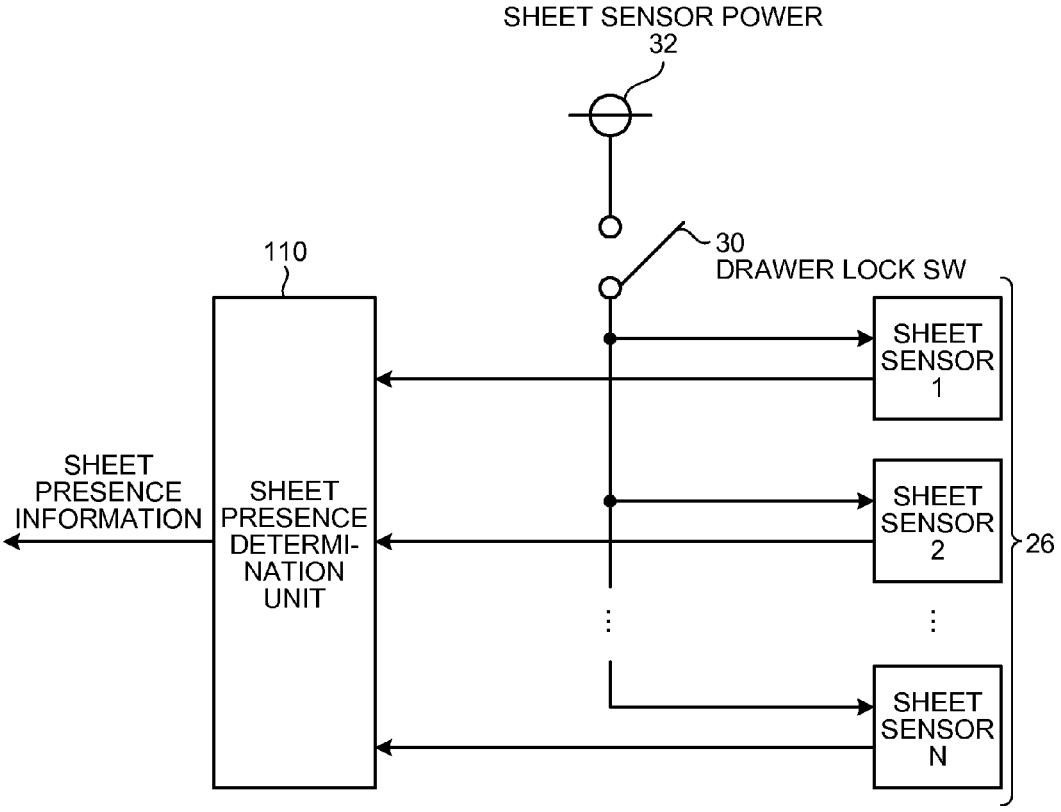
FIG. 4 is an explanatory diagram of a method of detecting whether there is a sheet when a front door is being open.

FIG. 4 is an explanatory diagram of a circuit that may be used for a method of detecting whether there is a sheet when the front door being open. FIG. 4 shows a configuration in which N sheet sensors 26 (detection units) are disposed. The image forming apparatus 100 according to the embodiment includes (N) sheet sensors 26, a sheet sensor power 32, a drawer lock switch (SW) 30, and a sheet presence determination unit 110.

Each of the (N) sheet sensors 26 is a sensor that, when supplied with power, detects whether there is a sheet conveyed on the conveyance path 28. Upon detecting a sheet on the conveyance path 28, the sheet sensor 26 transmits a detection signal indicating that there is a sheet to the sheet presence determination unit 110. In other words, when there is a sheet on the conveyance path 28, paper jam has occurred.

The sheet sensor power 32 supplies power to the sheet sensor 26. The sheet sensor power 32 according to the embodiment is configured so as to supply a power of 5 V to the sheet sensor 26; however, it is not limited to this.

The drawer lock SW 30 is configured to be switched on/off in accordance with the direction of the lever 24 that is disposed on the drawer unit 22. When the lever 24 is at the vertical position (24*b*) and the drawer unit 22 is locked, the drawer lock SW 30 is switched on. When the drawer lock SW 30 is switched on, the sheet sensor power 32 and the sheet sensor 26 are connected so that power is supplied from the sheet sensor power 32 to the sheet sensor 26.

On the other hand, when the lever 24 is at the horizontal position (24*a*) and the drawer unit 22 is unlocked, the drawer lock SW 30 is switched off. When the drawer lock SW 30 is switched off, the sheet sensor power 32 and the sheet sensor 26 are disconnected so that the power supply from the sheet sensor power 32 to the sheet sensor 26 is cut off. The sheet sensor power 32 and the drawer lock SW 30 correspond to the first power supply unit.

The reason why the power supply to the sheet sensor 26 is not controlled in accordance with the insertion and pulling out of the drawer unit 22 but is controlled in accordance with the direction of the lever 24 is in order to eliminate the stress on electronic parts due to hot swap (pulling out and insertion of the drawer unit 22 when the power is being supplied).

According to whether a detection signal from the sheet sensor 26 has been received, the sheet presence determination unit 110 determines whether there is a sheet conveyed on the conveyance path 28. The sheet presence determination unit 110 transmits, to a controller (not shown), sheet presence information indicating the result of determination of whether there is a sheet. In other words, the sheet presence determination unit 110 transmits, to the controller, sheet presence information indicating that there is a sheet on the conveyance path 28, or sheet presence information indicating that there is no sheet on the conveyance path 28. Because the case where a detection signal is received is the case where there is a sheet on the conveyance path 28, the sheet presence determination unit 110 adds the position of the sheet sensor 26, which has transmitted the detection signal, as the jammed sheet position to the sheet presence information and transmits the sheet presence information to the controller.

Upon receiving the sheet presence information, the controller displays information (indicating that there is no sheet, or that there is a sheet and a jammed sheet position) indicated by the sheet presence information on the monitor 10 to present the information to the user. The controller further includes an image forming unit (not shown) that forms an image on a sheet.

Figure 5:
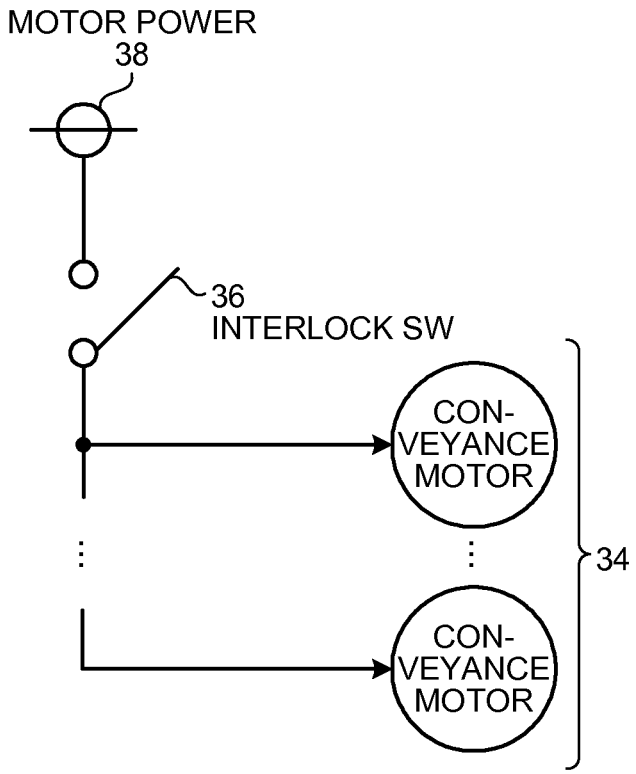
FIG. 5 is an explanatory diagram of conveying of a sheet when the front door is being open.

FIG. 5 is an explanatory diagram of conveying of a sheet when the front door is being open. The image forming apparatus 100 according to the embodiment includes a conveyance motor 34, a motor power 38, and an interlock SW 36.

The conveyance motor 34 causes a sheet to be conveyed on the conveyance path 28 by being supplied with power. The conveyance motor 34 corresponds to a drive unit that causes the drawer unit 22 to perform a given operation. According to the embodiment, conveying of a sheet is exemplified as the given operation.

The motor power 38 supplies power to the conveyance motor 34. The motor power 38 according to the embodiment is configured so as to supply a power of 24 V to the conveyance motor 34; however, it is not limited to this.

The interlock SW 36 is configured to be switched on/off in accordance with the open/close state of the front door 20. The interlock SW 36 is switched on when the front door is being close. When the interlock SW 36 is switched on, the motor power 38 and the conveyance motor 34 are connected so that power is supplied from the motor power 38 to the conveyance motor 34.

On the other hand, the interlock SW 36 is switched off when the front door is being open. When the interlock SW 36 is switched off, the motor power 38 and the conveyance motor 34 are disconnected so that the power supply from the motor power 38 to the conveyance motor 34 is cut off. The motor power 38 and the interlock SW 36 correspond to the second power supply unit.

Figure 6:
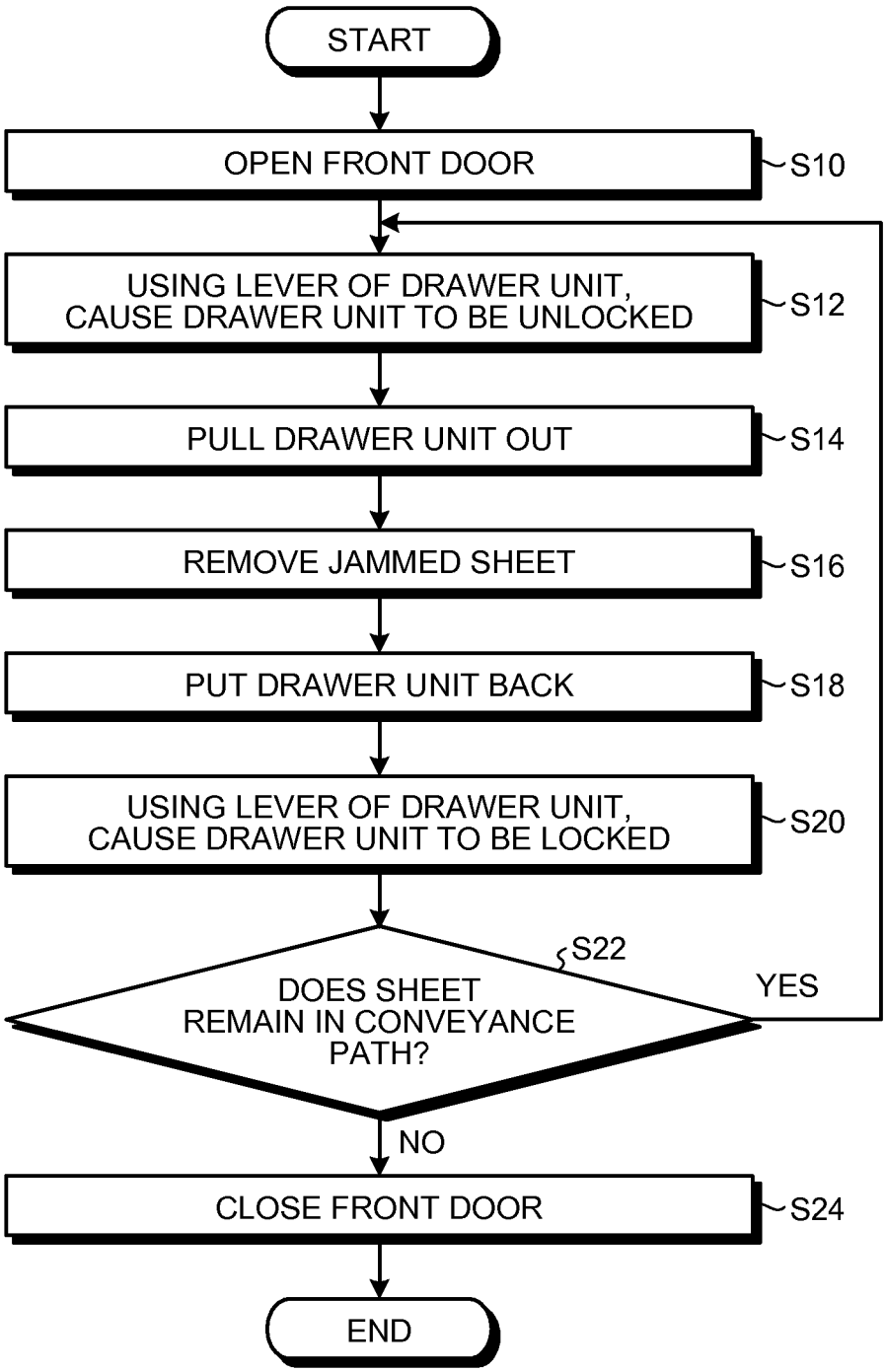
FIG. 6 is a flowchart of a procedure of paper jam processing performed by the image forming apparatus according to the embodiment.

The procedure of the paper jam processing performed by the image forming apparatus according to the embodiment will be described. FIG. 6 is a flowchart of the procedure of the paper jam processing performed by the image forming apparatus according to the embodiment.

When a user opens the front door 20, the interlock SW 36 is turned off (step S10). Accordingly, the motor power 38 and the conveyance motor 34 are disconnected so that the power supply to the conveyance motor 34 is cut off.

Using the lever 24 of the drawer unit 22, the user causes the drawer unit 22 to be unlocked (step S12). When the user causes the lever 24 of the drawer unit 22 to be at the horizontal position and the drawer unit 22 is unlocked, the drawer lock SW 30 is switched off. Accordingly, the sheet sensor power 32 and the sheet sensors 26 are disconnected so that the power supply to the sheet sensors 26 is cut off.

The user then pulls the drawer unit 22 out of the main unit (step S14) and the jammed sheet on the conveyance path 28 is removed (step S16). The user then puts the drawer unit 22 back to the main unit (step S18). In this manner, the paper jam processing is performed.

Using the lever 24 of the drawer unit 22, the user causes the drawer unit 22 to be locked (step S20). The user causes the lever 24 of the drawer unit 22 to be at the vertical position and the drawer unit 22 is locked, and then the drawer lock SW 30 is switched on. Accordingly, the sheet sensor power 32 and the sheet sensor 26 are connected so that power is supplied to the sheet sensor 26.

According to whether a detection signal from the sheet sensor 26 has been received, the sheet presence determination unit 110 determines whether the sheet remains on the conveyance path 28 (step S22). When the sheet remains on the conveyance path 28 (YES at step S22), the controller displays the fact and the jammed sheet position on the monitor 10 to let the user know them and accordingly, the image forming apparatus returns to step S12.

On the other, when there is no sheet remaining on the conveyance path 28 (NO at step S22), the controller displays the fact on the monitor 10 to let the user know it. Because this means that the paper jam is fixed, the user closes the front door 20 and the interlock SW 36 is switched on (step S24). Accordingly, the motor power 38 and the conveyance motor 34 are connected so that power is supplied to the conveyance motor 34, and the processing ends.

The procedure of the sheet presence determination processing at step S22 will be described here. FIG. 7 is a flowchart of the procedure of the sheet presence determination processing performed by the sheet presence determination unit. FIG. 7 shows the processing performed when there are N sheet sensors 26 that are denoted by 1 to N.

The sheet presence determination unit 110 determines whether a detection signal indicating whether there is a sheet has been received from the sheet sensor 1 (step S30). When a detection signal has been received from the sheet sensor 1 (YES at step S30), the sheet presence determination unit 110 determines that "there is a sheet" at the position of the sheet sensor 1 (step S32) and stores the position of the sheet sensor 1 and the fact that there is a sheet.

When no detection signal has been received from the sheet sensor 1 (NO at step S30), the sheet presence determination unit 110 determines that "there is no sheet" at the position of the sheet sensor 1 (step S34) and stores the fact that there is no sheet at the position of the sheet sensor 1.

The sheet presence determination unit 110 determines whether a detection signal has been received from the sheet sensor 1 (step S36). When a detection signal has been received from the sheet sensor 2 (YES at step S36), the sheet presence determination unit 110 determines that "there is a sheet" at the position of the sheet sensor 2 (step S38) and stores the position of the sheet sensor 2 and the fact that there is a sheet.

When no detection signal has been received from the sheet sensor 2 (NO at step S36), the sheet presence determination unit 110 determines that "there is no sheet" at the position of the sheet sensor 2 (step S40) and stores the position of the sheet sensor 2 and the fact that there is no sheet.

This processing is performed for the sheet sensors 1 to N. The sheet presence determination unit 110 determines whether a detection signal has been received from the sheet sensor N (step S42). When a detection signal has been received from the sheet sensor N (YES at step S42), the sheet presence determination unit 110 determines that "there is a sheet" at the position of the sheet sensor N (step S44) and stores the fact that there is a sheet at the position of the sheet sensor N.

On the other hand, when no detection signal has been received from the sheet sensor N (NO at step S44), the sheet presence determination unit 110 determines that "there is no sheet" at the position of the sheet sensor N (step S46) and stores the position of the sheet sensor N and the fact that there is no sheet.

The sheet presence determination unit 110 then determines whether it is determined that "there is no sheet" at all the positions of the sheet sensors 1 to N (step S48). When it is determined that "there is no sheet" at all the positions of the sheet sensors 1 to N (YES at step S48), the sheet presence determination unit 110 transmits sheet presence information indicating that there is no sheet on the conveyance path 28 to the controller (step S50) and ends the processing. The controller then displays the fact that there is no sheet at all the positions of the sheet sensors 1 to N to notify the user of the fact.

On the other hand, when it is determined that "there is no sheet" at not all the positions of the sheet sensors 1 to N (NO at step S48), the sheet presence determination unit 110 transmits sheet presence information indicating that there is a sheet on the conveyance path 28 to the controller while including the information on the jammed sheet position in the transmitted information (step S52) and ends the processing. The controller displays the sheet sensor where there is a sheet and the jammed sheet position on the monitor 10 to notify them. The jammed sheet position is the position of the sheet sensor where there is the sheet.

Figure 8:
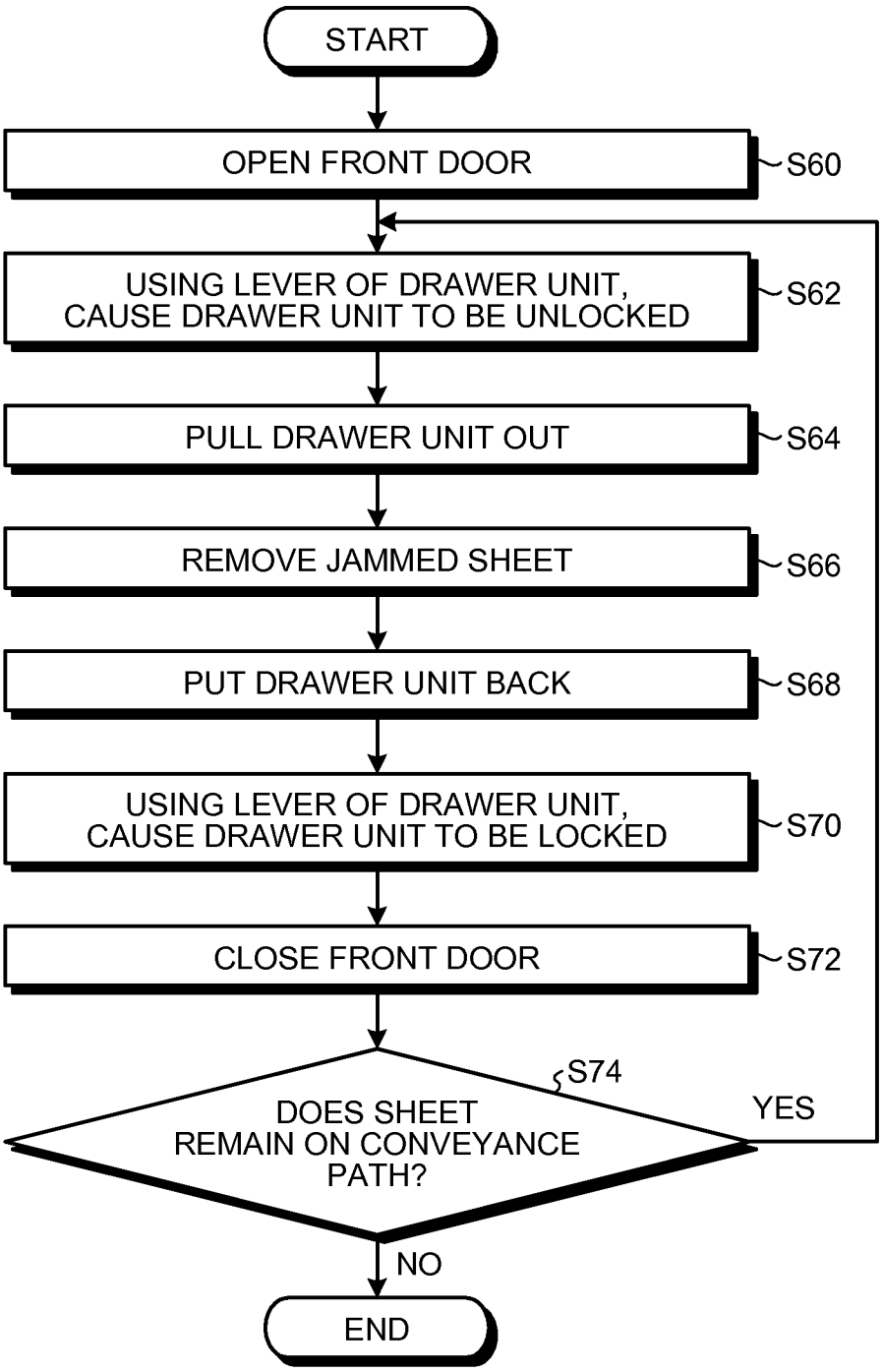
FIG. 8 is a flowchart of a procedure of paper jam processing performed by a conventional image processing apparatus.

A procedure of paper jam processing performed by a conventional image forming apparatus will be described here. FIG. 8 is a flowchart of the procedure of the paper jam processing performed by the conventional image forming apparatus.

The processing from when the user opens the front door 20 until when the user causes the lever 24 of the drawer unit 22 to be at the vertical position to lock the drawer unit 22 (steps S60 to S70) is the same as the processing at steps S10 to S20 shown in FIG. 6.

The user then closes the front door 20 and the interlock SW 36 is switched on (step S72). Accordingly, the motor power 38 and the conveyance motor 34 are connected so that power is supplied to the conveyance motor 34.

According to whether a detection signal from the sheet sensor 26 has been received, the sheet presence determination unit 110 determines whether the sheet remains on the conveyance path 28 (step S74). When the sheet remains on the conveyance path 28 (YES at step S74), the controller displays the fact and the jammed sheet position on the monitor 10 to let the user know them, and the image forming apparatus returns to step S62.

On the other hand, when there is no sheet remaining on the conveyance path 28 (NO at step S74), the controller displays the fact on the monitor 10 to let the user know the fact, and the processing ends. In this manner, in the conventional image forming apparatus, the drawer unit 22 is put back after the paper jam processing, and the operation check is performed after the front door 20 is closed.

As described above, in the image forming apparatus according to the embodiment, when paper jam occurs, the front door 20 is opened, the drawer unit 22 is unlocked, the drawer unit 22 is pulled out of the main unit, and the paper jam processing is performed. After the paper jam processing and when the drawer unit 22 is put back into the main unit and is caused to be locked, it is possible to perform an operation check for checking whether the paper jam has been fixed. In other words, because it is possible to perform an operation check without closing the front door 20 when the drawer unit 22 is returned to the main unit, it is possible to perform the operation check without paying attention to the opening and closing angle of the front door, which increase convenience.

For the embodiment, the image forming apparatus that forms an image on a recording medium is exemplified as an electronic apparatus to which the invention is applied; however, it is not limited to this. The present invention may be applied to any type of electronic apparatus.

The embodiment provides an effect that the convenience is increased in an operation check after processing on a failure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electronic apparatus comprising: a unit part that can be pulled out of a main unit;

a cover part that is disposed in a direction in which the unit part is pulled out, with respect to the unit part, and is configured to, when closed, cover the unit part;

a lock part that, if the cover part is opened, is movable to a first position where it is possible to pull the unit part out of the main unit and is movable to a second position where it is impossible to pull the unit part out of the main unit; and a circuit configured to perform an operation check, the circuit including, a detection unit configured to, when being supplied with power, detect an internal state of the unit part, and a first power supply unit configured to, based on a position of the lock part, shut off a first supply of power to the detection unit when the lock part is moved to the first position, and provide the first supply of power to the detection unit when the lock part is moved to the second position, wherein the circuit performs the operation check based on a detection result of the detection unit if the unit part is put back into the main unit and the lock part is moved to the second position, the circuit being configured to perform the operation check even during times when the cover part is opened.

2. The electronic apparatus according to claim 1, further comprising:

a drive unit configured to, when being supplied with power, cause the unit part to perform a given operation; and a second power supply unit configured to shut off a second supply of power to the drive unit when the cover part is being opened, and provide the second supply of power to the drive unit when the cover part is being closed.

3. The electronic apparatus according to claim 1, wherein the detection unit is a sensor configured to detect whether there is a recording medium.

4. The electronic apparatus according to claim 1, wherein the detection unit is a sensor configured to detect a remaining amount of a consumable.

5. The electronic apparatus according to claim 1, wherein the lock part is a lever, and the first position and the second position are positions to which the lock part is moved by switching a direction of the lock part.

6. An image forming apparatus comprising:

the electronic apparatus according to claim 1; and an image forming unit that forms an image on a recording medium.

7. A state detection method that is performed by an electronic apparatus, the electronic apparatus comprising:

a unit part that can be pulled out of a main unit;

a cover part that is disposed in a direction in which the unit part is pulled out, with respect to the unit part, and is configured to, when closed, cover the unit part; and a lock part that, if the cover part is opened, is movable to a first position where it is possible to pull the unit part out of the main unit and is movable to a second position where it is impossible to pull the unit part out of the main unit, the state detection method comprising:

detecting an internal state of the unit part when power is being supplied;

based on a position of the lock part, shutting off a supply of power to a detection unit when the lock part is moved to the first position and supplying power to the detection unit when the lock part is moved to the second position; and performing an operation check based on a detection result during the detecting if the unit part is put back into the main unit and the lock part is moved to the second position, the performing of the operation check occurring even during times when the cover part is opened.

8. The electronic apparatus of claim 1, wherein the circuit is further configured to determine whether a paper jam is fixed in the operation check and display on a monitor whether the paper jam is fixed, the monitor being on the electronic apparatus.

9. The electronic apparatus of claim 1, wherein the detection unit includes a plurality of sheet sensors and the circuit is further configured to determine whether a paper jam is fixed based on whether all of the plurality of sheet sensors detect there is no sheet.

* * * * *